US005150595A

United States Patent [19]

Ihly

[11] Patent Number: 5,150,595

[45] Date of Patent: Sep. 29, 1992

[54] PROCESS AND APPARATUS FOR WORKING AN EDGE PORTION OF A CONTAINER FLANGE

[75] Inventor: Eugen F. Ihly, Denver, Colo.

[73] Assignee: Ihly Industries, Inc., Englewood, Colo.

[21] Appl. No.: 697,751

[22] Filed: May 9, 1991

[51] Int. Cl.[5] ..... B21B 19/14

[52] U.S. Cl. ..... 72/124; 72/112; 72/126; 72/105

[58] Field of Search ..... 72/112, 118, 122, 123, 72/124, 126, 105, 106

[56] References Cited

U.S. PATENT DOCUMENTS

| | | | |
|---|---|---|---|
| 1,606,677 | 11/1926 | Vanderslice | 72/106 |
| 2,335,260 | 11/1943 | Chamberlain | 220/74 |
| 3,418,837 | 12/1968 | Venderlaan et al. | 72/94 |
| 3,469,428 | 9/1969 | Aschberger | 72/94 |
| 3,688,538 | 9/1972 | Hoyne | 72/94 |
| 3,754,424 | 8/1973 | Costanzo | 72/105 |
| 4,018,176 | 4/1977 | Gnyp et al. | 72/94 |
| 4,058,998 | 11/1977 | Franek et al. | 72/84 |
| 4,070,888 | 1/1978 | Gombas | 72/91 |
| 4,341,103 | 7/1982 | Escallon et al. | 72/70 |
| 4,402,202 | 9/1983 | Gombas | 72/124 |
| 4,450,700 | 5/1984 | Robertson et al. | 72/118 |
| 4,512,172 | 4/1985 | Abbott et al. | 72/68 |
| 4,563,887 | 1/1986 | Bressan et al. | 72/84 |
| 4,578,007 | 3/1986 | Diekhoff | 413/6 |
| 4,606,207 | 8/1986 | Slade | 72/96 |
| 4,732,027 | 3/1988 | Traczyk et al. | 72/133 |
| 4,781,047 | 11/1988 | Bressan | 72/84 |

FOREIGN PATENT DOCUMENTS

| | | | |
|---|---|---|---|
| 0135730 | 8/1983 | Japan | 72/124 |
| 0163029 | 9/1984 | Japan | 72/126 |
| 602423 | 7/1978 | Switzerland . | |
| 1395403 | 5/1988 | U.S.S.R. | 72/124 |
| 1400718 | 6/1988 | U.S.S.R. | 72/124 |
| 2092492 | 8/1982 | United Kingdom . | |

*Primary Examiner*—David Jones
*Attorney, Agent, or Firm*—Sheridan Ross & McIntosh

[57] ABSTRACT

A process and apparatus for working an edge portion of a flange positioned on an open end of a container to prepare the flange for end-piece attachment by shaping such edge portion and improving flange uniformity, and, if desired, configuring the flange into a desired angular orientation. In one embodiment a plurality of working rollers are positioned radially outward from the edge of the flange and a mechanism is used to force at least portions of the flange toward the rollers. When at least a portion of the flange engages with at least one of the rollers as the rollers are rotated relative to and about the flange, flange uniformity is improved as the flange edge is shaped by such roller. In the event the flange continues to be forced toward the working rollers, remaining portions of the flange may approach and possibly contact the rollers to be shaped and worked thereby while the outward radial movement of the initial contacting edge portion is restrained, thereby further improving flange uniformity.

26 Claims, 4 Drawing Sheets

PROCESS AND APPARATUS FOR WORKING AN EDGE PORTION OF A CONTAINER FLANGE

FIELD OF THE INVENTION

This invention generally relates to the field of forming cylindrical containers and, more particularly, to working an edge portion of a flange positioned on an open end of a container with a plurality of rollers to prepare the flange for end-piece attachment by shaping such edge portion and improving flange uniformity, and, if desired, configuring the flange into a particular angular orientation.

BACKGROUND OF THE INVENTION

Metal containers are generally of either two-piece or three-piece construction. Two-piece containers are typically manufactured by a drawing and ironing process to produce a container having a continuous bottom and sidewall to which a separate end piece is connected on the open end thereof to form a closed container. Three-piece containers are typically manufactured from metal roll stock that is cut into strips having a width that will substantially define the height of the resultant container and a length which will effectively define its diameter. Each strip is then formed into a cylindrical shape and the opposing edges of the strip are attached by processes known in the art, such as welding. With this type of construction, two end pieces must be separately attached to the open ends of the cylinder to form a closed container.

A key portion of the construction process for both two- and three-piece containers involves attaching at least one end piece to seal the container. In establishing the connection, typically a flange is formed on the open end(s) of the container to receive the end piece(s). The flange, which is most often a continuation of the sidewall of the container, is formed and configured to yield a desired angular relationship with respect to the sidewall. This angular relationship may vary depending upon, in part, the particular end-piece attachment method to be utilized. Regardless of the end orientation of the flange and the attachment method to be utilized, it is desirable to have a flange of substantially uniform width in order to obtain an adequate seal between the flange and the end piece attached thereto.

One method often used to secure an end piece to a flanged end of a container is by curling. An end piece, typically having a hooked outer edge, is placed on the flanged end of the container. After properly positioning the end piece relative to the flange, the flange and the end piece are curled together as is well known in the art to seal the container. In the event a nonuniform flange is used in this particular attachment process, the potential exists that there may not be a sufficient amount of flange around certain portions of the perimeter of the container to effectively perform curling operations (i.e., to properly interconnect the flange and the end piece), thereby yielding an undesirable seal in these areas.

An alternative method for attaching an end piece to the flanged end of a container is through use of a snap-on lid. In the snap-on method, the flange is typically configured such that the flange edge is downwardly oriented to a desired degree and shape and the lid has a ring-like ridge or other similar surface such that when the lid is placed over the flange, the ridge will intimately engage the lower or underside of the flange. Although not necessarily required, quite often the lid is of a slightly smaller diameter than that of the perimeter of the outer, downwardly oriented edge of the flange. Consequently, the flange-engaging portion of the lid is forced outward and/or the flange edge is forced inward when the lid is placed over and "snapped" onto the container. As can be appreciated, if a nonuniform or improperly oriented flange is used with this attachment method, the potential also exists for an inconsistent or insufficient container flange/lid interface, thereby yielding an ineffective seal in the corresponding areas.

SUMMARY OF THE INVENTION

The present invention is a process and apparatus for working an edge portion of a container flange with a plurality of rollers to prepare the flange for end-piece attachment by shaping such edge portion and improving the uniformity of the flange, and, if desired, configuring the flange into a desired angular orientation for end-piece engagement.

One embodiment of the apparatus of the present invention generally includes a plurality of rotatable working rollers positioned radially outward from the flange edge, a mechanism for imparting relative rotational motion between the rollers and the container about its longitudinal axis, and a mechanism for forcing the flange toward the working rollers. The rotating working rollers limit the amount of outward radial movement of the flange and thus effectively define its desired end configuration. Moreover, once contact is established between at least one of the working rollers and at least a portion of the flange edge, the effective "travelling" of the working rollers about the perimeter of the flange edge works and shapes this edge portion to improve flange uniformity and circularity. In the event the flange continues to be forced toward the working rollers, then depending upon the contour of the outer rollers and extent of radial flange movement, the flange may be oriented and shaped as desired. Since the outward radial movement of those edge portions contacting the working rollers is restrained during such further working, flange uniformity and circularity can be further improved.

As can be appreciated, the working rollers may assume a variety of positions and still function to limit the outward radial movement of the flange and work flange edge portions. For instance, in one embodiment the rotational axes of such rollers are substantially parallel with the longitudinal axis of the container. In another embodiment the rotational axes of the working rollers are positioned transverse to the longitudinal axis of the container. Preferably, in all embodiments the working rollers are substantially concentrically positioned about the central, longitudinal axis of the container.

Depending upon the particular end-piece attachment method to be utilized, it may be desirable to configure the flange into a particular angular orientation. In this regard, and as noted above, the surface of one or more of the working rollers may be configured so as to not only limit the outward radial movement of the flange, but also to work the flange into a desired angular orientation and shape. For instance, in one embodiment the surface of at least one of the working rollers is substantially cylindrical such that when the rotational axis of the roller is substantially parallel with the longitudinal axis of the container, the flange will be configured to be substantially normal to the sidewall of the container by the working rollers. In another embodiment at least a portion of the surface of at least one of the working rollers is tapered, preferably to work the flange into a downward orientation. In still another embodiment at least a portion of the surface of at least one of the working rollers is concave to work the flange into a downward curl.

The present invention only requires that there by relative rotational motion between the plurality of working rollers and the container, more particularly the flange edge. In one embodiment the plurality of working rollers are freely and rotatably attached to a housing which is rotatably driven by an appropriate drive source. In this embodiment the container is appropriately secured, typically away from the end of the container to be worked, so as to not interfere with the performance of the process of the present invention. Although the container could be rotated at a different speed than that of the housing, preferably the container remains substantially stationary in this embodiment. However, in another embodiment the housing on which the working rollers are attached remains substantially stationary while the container, again appropriately secured, is rotated by an appropriate drive source.

The present invention also only requires that at least a portion of the flange edge be forced toward the plurality of working rollers to contact at least one of such rollers to be shaped and worked thereby. This movement can be achieved in a variety of ways, but conveniently is available by utilizing existing container forming/processing apparatus. For instance, in one embodiment the movement of the flange edge toward the working rollers is provided by a plug resizing apparatus which increases the diameter of the throat of a container from a first diameter to a desired second diameter, which is not a requirement of the present invention. As a result of this throat resizinq process, however, the flange is forced radially outward as is required by the present invention. In another embodiment the required flange movement is provided by a plugger which forms and/or directs the flange toward the working rollers by driving, relatively, the open end of the container against an appropriately contoured accurate surface. With both types of apparatus described herein, it can be appreciated that such can be used on both straight-walled, open-ended containers and those which already have a flange position on the open end in an initial angular orientation.

The process of the present invention will be described with reference to utilizing a particular plug resizing apparatus and a container having a preformed flanged (i.e., one having a flange formed with an initial angular orientation). This particular plug resizing apparats includes a plurality of tapered resizing rollers which are freely and rotatably attached to a housing in concentric fashion about its longitudinal axis. The plurality of working rollers are then positioned radially outward from the resizing rollers, and in this embodiment are also concentrically positioned about the housing's longitudinal axis. Although only relative rotational motion is required between the plug resizing apparatus and the container, preferably the plug resizing apparatus is rotated and axially advanced toward a substantially stationary container whose central longitudinal axis is aligned with the rotational axis of the plug resizing apparatus. As the rotating plug resizing apparatus is then axially advanced toward the container, the resizing rollers contact and rotate around the interior of the open end of the container in the region of the throat. As the apparatus continues its inward axial progression, the diameter of the throat is increased due to the outward taper of the resizing rollers which also forces the preformed flange toward the working rollers. Once contact is established between at least a portion of the edge of the preformed flange and at least one of the working rollers, the rotational motion of the working rollers about the flange edge shapes this edge portion and improves flange uniformity. In the event further inward axial progression of the resizing rollers continues after this initial contact is established, remaining portions of the flange edge will approach and possibly contact the working rollers to be shaped and worked thereby. Since the outward radial movement of the flange edge portions which have contacted the working rollers is restrained during this process, flange uniformity is further improved. As previously discussed, if a particular angular orientation of the flange is desired, the surface of at least one of the working rollers may be contoured to not only restrain outward radial movement of the flange and shape such edge portions, but also to work the flange into the desired angular orientation.

The present invention advantageously prepares the flanged end of a container for end-piece attachment by working flange edge portions to shape the flange edge and improve flange uniformity, and may also be used to configure the flange into a desired angular orientation by utilizing an appropriate contour for the body of the working rollers. The present invention, however, is also quite versatile. For instance, existing container forming/processing apparatus may be adapted to assist in performing the process of the present invention. Moreover, various types of containers may be prepared for edge-piece attachment such as those which are flange/unflanged, necked/unnecked, and/or beaded/unbeaded.

DETAILED DESCRIPTION

Figure 1:
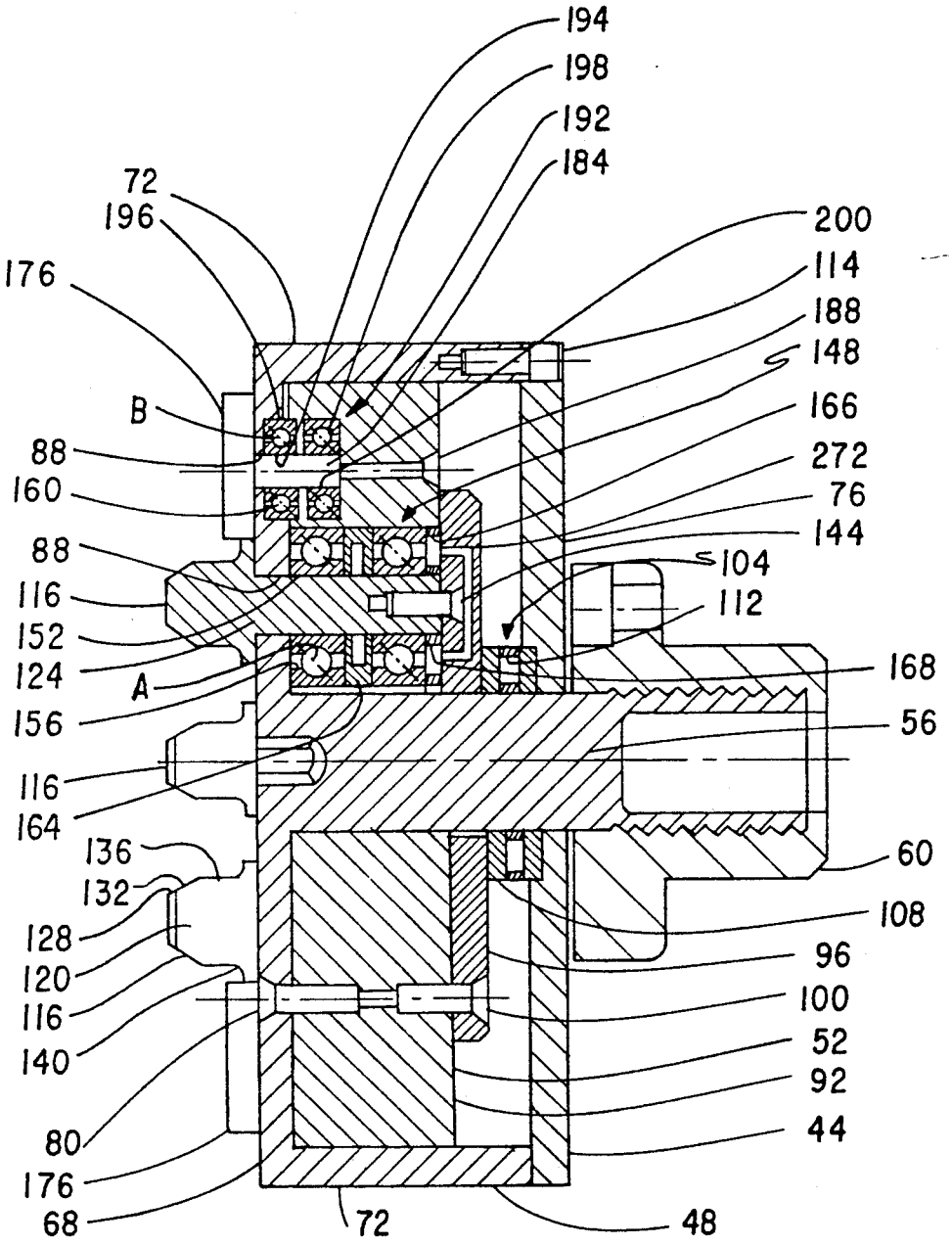
FIG. 1 is a cross-sectional view of a plug resizing apparatus which has been adapted to perform the process of the present invention.

The present invention will be described with reference to the attached drawings which serve to illustrate the pertinent features thereof. Generally, the process and apparatus of the present invention prepare a flanged container for end-piece attachment by shaping at least a flange edge portion, improving flange uniformity, and, if desired, configuring the flange into a desirable angular orientation relative to the sidewalls of the container. In providing these desirable features, the present invention utilizes a plurality of rotatable working rollers positioned radially outward from the container flange, a mechanism for providing relative rotational motion between the working rollers and the flange edge, and a mechanism for forcing the flange toward the working rollers such that at least a portion of the flange edge contacts, and is shaped and worked by, at least one of the working rollers.

There are a variety of ways in which the flange may be directed toward the working rollers, and for that matter in which relative rotational motion between the working rollers and the flange edge may be achieved, all of which are contemplated by and are within the scope of the present invention. For instance, the working rollers may be used in combination with a plug resizing apparatus which not only increases the diameter of the throat of a container (not required by the present invention), but which as a result of such resizing forces portions of the container, more particularly the flange, toward the working rollers in a manner required by the present invention. Furthermore, the working rollers may be used in combination with a plugging apparatus having an arcuate surface against which the open end of a container is driven to force the flange toward the working rollers. Consequently, although the illustrated embodiments discussed below may provide additional functions not essential to the practice of the present invention, they emphasize the versatility possessed by the present invention in its ability to be adapted for use with existing container forming/processing equipment to provide the desired results.

One embodiment of an apparatus of the present invention will be described with reference to the first plug resizing apparatus 44 of FIGS. 1-2 as it is used with the container 16 of FIG. 3. The container 16 of FIG. 3 is of two-piece construction and therefore includes a bottom 20 which is integrally formed with the sidewalls 32. Furthermore, the container 16 has been necked in by processes known in the art such that the throat 36 is of a smaller diameter than the main body portion of the container 16. Consequently, the size of the end piece (not illustrated) required to seal the container 16 by engaging with the preformed flange 40 is reduced.

Generally, the first plug resizing apparatus 44 of FIGS. 1-2 improves the circularity of and resizes the throat 36 of the container 16 (FIG. 3) in a manner described below, both of which are not required to practice the present invention. However, as a result of this resizing process, the flange 40 of the container 16 is also forced radially outward as is required by the present invention such that at least a portion of the flange 40, more particularly its edge, contacts at least one of the first working rollers 176 which have been conveniently and appropriately incorporated within the structure of the first plug resizing apparatus 44 (i.e., radially outward from the flange 40). The relative rotation of these first working rollers 176 about the edge of the flange 40 thus works and shapes at least an edge portion of the flange 40 and also restrains further outward radial movement of those portions of the flange 40 which contact the first working rollers 176, all of which improve the uniformity of and configure the flange 40. Consequently, when an end piece (not shown) is attached to the flange 40 in a desired manner, an improved seal is obtained in closing the container 16

The first plug resizing apparatus 44 generally includes a first outer housing 48 and a first inner housing 52 which are interconnected such that the entire first plug resizing apparatus 44 is able to rotatably and axially advance relative to the container 16 (FIG. 3). The first outer housing 48 has a first face 68 which is integrally formed with the first sides 72 to effectively define a receiving area in which the first inner housing 52 is seated. More particularly, the bearing block 92 of the first inner housing 52, which supports the resizing rollers 116 and the first working rollers 176, is positioned in this receiving area and is attached to the first face 68 of the first outer housing 48 by a plurality of first cap screws 80 (one shown). For purposes of properly securing the first bearing assembly 148 of each resizing roller 116 and the second bearing assembly 192 of each first working roller 176, a bearing backing plate 96 is attached to the bearing block 92 with a plurality of second cap screws 100 (one shown). The first inner housing 52 is then enclosed within the first outer housing 48 by attaching a main backing plate 76 to the first outer housing 48, particularly portions of the first sides 72, with a plurality of third cap screws 114 (one shown). Since the first plug resizing apparatus 44 experiences an axial force when performing the process of the present invention, the first inner housing 52 and the first outer housing 48 are axially separated by a thrust bearing assembly 104, having thrust washers 108 and a thrust bearing 112, to provide desirable axial support.

The first inner housing 52 supports both the resizing rollers 116 and the first working rollers 176 which have portions, namely shafts 124, 184, respectively, which extend through a plurality of shaft bores 88 in the first face 68 (two shown) to engage the bearing block 92. More particularly, each resizing roller 116 and each first working roller 176 is supported by a first bearing assembly 148 and a second bearing assembly 192, respectively, which are seated and held between portions of the bearing block 92 and the first face 68. Furthermore, each resizing roller 116 and first working roller 176 is secured to the bearing block 92 by fourth and fifth cap screws 144, 188, respectively, which engage with shafts 124, 184, respectively.

The first bearing assembly 148, which supports each resizing roller 116, generally includes a first inner sleeve 152, the inner portion of which contacts the shaft 124 of the supported resizing roller 116, a first outer sleeve 156, the outer portion of which contacts an inner surface of the bearing block 92, and a plurality of first ball bearings 160 which are positioned between first inner sleeve 152 and first outer sleeve 156 to reduce friction therebetween and to support the resizing rollers 116. Preferably, the first bearing assembly 148 is a type commonly referred to in the art as a single row, angular contact roller bearing which is designed to support combined radial and axial loads. Consequently, the first ball bearings 160 are shown in FIG. 1 as having an inclined axis A. Moreover, preferably two (2) first bearing assemblies 148 are used to support each shaft 124 of the resizing rollers 116. In this particular configuration, a middle spacer 164 separates the two first bearing assemblies 148, an end spacer 166 separates the first outer sleeve 156 of the rearward-most first bearing assembly 148 from the bearing backing plate 96, and springs 168 separate the first inner sleeve 152 of the rearward-most first bearing assembly 148 from the bearing backing plate 96. The springs 168 allow the resizing rollers 116 to have limited linear travel to accommodate for slightly different conditions encountered during the performance of the resizing process of the throat 36. To further assist in absorbing the axial loads encountered during performance of the resizing process, a thrust collar 272 is positioned at the lower portion of each shaft 124 of the resizing rollers 116.

The first inner housing 52 also supports the first working rollers 176. In this regard, a second bearing assembly 192 is appropriately positioned therein and is substantially similar to the first bearing assembly 148 discussed above. Consequently, each second bearing assembly 192 includes a second inner sleeve 194, the inner portion of which contacts the shaft 184 of the supported first working roller 176, a second outer sleeve 196, the outer surface of which contacts an inner surface of the bearing block 92, and a plurality of second ball bearings 198 which are positioned between the second inner sleeve 194 and the second outer sleeve 196. Again, as with the first bearing assembly 148, the second bearing assembly 192 is preferably of the type commonly referred to as a single row, angular-contact roller bearing. Consequently, the second ball bearings 198 are illustrated in FIG. 1 as having an inclined axis B. Moreover, preferably two second bearing assemblies 192 are used for each shaft 184 of the supported first working rollers 176 which are separated by a spacer 200. Springs similar to springs 168 used with the first bearing assemblies 148 may also be incorporated for the second bearing assemblies 192 although such springs are not illustrated in FIG. 1.

As previously stated, the first plug resizing apparatus 44 rotates and axially advances relative to the container 16 (FIG. 3) to perform the process of the present invention, in addition to resizing the throat 36 of the container 16 which is again not required by the present invention. Preferably, the first plug resizing apparatus 44, through connection via an adapter 60 with a first drive shaft 56 which is in turn integrally connected to the first face 68 as illustrated in FIG. 1, is rotated and axially advanced by a drive mechanism (not shown) toward a substantially stationary container 16 (FIG. 3) which is appropriately secured so as to not interfere with operation of the first plug resizing apparatus 44. As can be appreciated, one or two drive mechanisms may be used to provide the desired rotational and axial motion. Moreover, relative rotational and axial motion are the only limitations in using the first plug resizing apparatus 44 in performing the process of the present invention. Therefore, the present invention may be incorporated within a substantially stationary first plug resizing apparatus 44 such that the container 16 (FIG. 3) will be rotated by an appropriate source and axially advanced into engagement with the first plug resizing apparatus 44.

For purposes of performing plug resizing operations, the first plug resizing apparatus 44 includes a plurality of resizing rollers 116. In order to effectively improve the circularity of the throat 36 of the container 16 (FIG. 3), increase the diameter thereof, and, for purposes of performing the process of the present invention, effectively assist in improving the uniformity of and configuring the flange 40 by providing the desired outward radial movement thereof, these resizing rollers 116 are substantially concentrically positioned about the first drive shaft 56 as best illustrated in FIG. 2. The first drive shaft 56 is also then substantially aligned with the central longitudinal axis of the container 16 for effective operation of the first plug resizing apparatus 44. Although five resizing rollers 116 are illustrated in FIG. 2, any number which will effectively increase the diameter of throat 36, and for purposes hereof force the flange 40 of the container 16 (FIG. 3) toward the first working rollers 176, may be utilized.

The resizing rollers 116 are specially configured to increase the diameter of the throat 36 as the first plug resizing apparatus 44 is axially advanced within the container 16 (FIG. 3). Generally, each resizing roller 116 includes a resizing body portion 120 of a desired contour which is exterior to the first face 68 and a shaft 124 which extends through a shaft bore 88 in the first face 6 to engage with the first bearing assembly 148 seated within the first inner housing 52 in the above-described manner. A preferred contour of the resizing body portion 120 is illustrated in FIGS. 1-2, namely having a first angled surface 128, a second angled surface 132, a support surface 136, and an arcuately-shaped base 140. The function of the first angled surface 128 is primarily to ensure that the resizing rollers 116 are able to enter the interior region of the throat 36 of the container 16 (i.e., the effective diameter of a circle tangent to the outer surfaces of the resizing rollers 116 in this region is less than the diameter of the throat 36 to be resized). However, in some instances, the first angled surface 128, as the resizing rollers 116 are axially advanced within the container 16, may also serve to increase the diameter of the throat 36, although this is the primary function of the second angled surface 132. Although two angles surfaces 128 and 132 are illustrated for each resizing roller 116, based upon the foregoing it can be appreciated that one or more angles surfaces may be utilized. More particularly, the only limitation of the contour of the resizing rollers 116 is that at least a portion of the resizing body portion 120 must taper outwardly toward the base 140 such that axial progression of the resizing rollers 116 within the container 16 will not only increase the diameter of the throat 36, but will also force the flange 40 out toward the first working rollers 176 as is required by the present invention.

As the resizing rollers 116 are axially advanced within the container 16 (FIG. 3), there may be a need for a portion of the resizing body portion 120 to support a portion of the throat 36 and/or the sidewall 32 of the container 16. More particularly, as the diameter of the throat 36 is increased in the described manner, the flange 40 is directed toward the first working rollers 176 and portions of the throat 36 and adjacent portions of the sidewall 32 may actually lose contact with the resizing rollers 116. However, once the flange 40 contacts at least one of the first working rollers 176, there may be a tendency for portions of the container 16 to snap back or at least be forced back toward the resizing rollers 116 since the first working rollers 176 restrain the outward radial movement of the flange 40 in the event inward progression of the resizing rollers 116 continues after the initial contact is established. Consequently, the resizing body portion 120 includes a support surface 136 which is substantially parallel with the rotational axes of the resizing rollers 116 to limit such snap-back and ultimately support, primarily, the throat 36 and possibly portions of the sidewall 32.

One primary requirement of the present invention is that at least a portion of the flange 40 must be forced toward the first working rollers 176. Consequently, each resizing roller 116 includes an arcuately-shaped base 140. In the event the flange 40 contacts the base 140 of a resizing roller 116 during the resizing of the throat 36, the arcuate surface of the base 140 will deflect the flange 40 toward the first working rollers 176. However, not only must the flange 40 be forced in this direction, but at least portions of the flange 40 must actually reach and engage at least one of the first working rollers 176 to work the flange 40 to achieve the desired results. Therefore, the inward axial progression of the first plug resizing apparatus 44 continues until this required contact is established when performing the process of the present invention.

The actual working of the edge of the flange 40 is achieved by the present invention by utilizing a plurality of first working rollers 176 which are positioned radially outward from the edge of the flange 40. In the case where the process of the present invention is performed with the first plug resizing apparatus 44 of FIGS. 1–2, the first working rollers 176 are positioned radially outward from the resizing rollers 116. Moreover, as in the case with the resizing rollers 116, the first working rollers 176 are preferably concentrically positioned about the first drive shaft 56 as best illustrated in FIG. 2 in this configuration. Although five first working rollers 176 are illustrated in the embodiment of FIGS. 1–2, any number may be utilized which will effectively perform the process of the present invention.

The first working rollers 176 limit the amount of outward radial movement of the flange 40 and thus effectively define the desired end configuration of the outer portions of the flange 40. When contact is established between at least one of the first working rollers 176 and an edge portion of the flange 40, the rotation of the first working rollers 176 thereabout works and shapes such edge portion and as a result improves the uniformity of the flange 40. Moreover, in the event the inward axial progression of the resizing rollers 116 continues, remaining edge portions of the flange 40 approach and in fact may contact the first working rollers 176 while the first working rollers 176 actually restrain further outward radial movement of those portions of the edge of the flange 40 which have already contacted the first working rollers 176. This further improves the uniformity of the flange 40.

Figure 3:
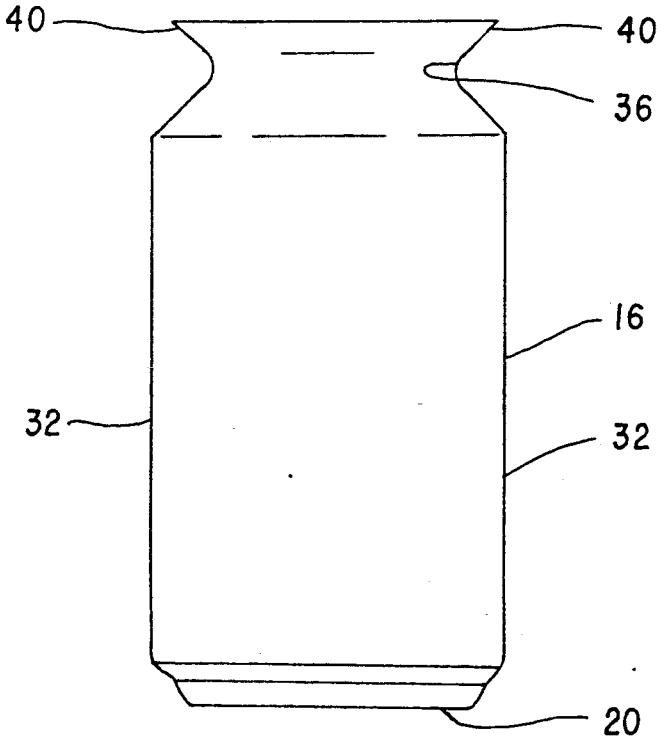
FIG. 3 is a side view of one type of container which may be worked by the present invention.
Figure 4:
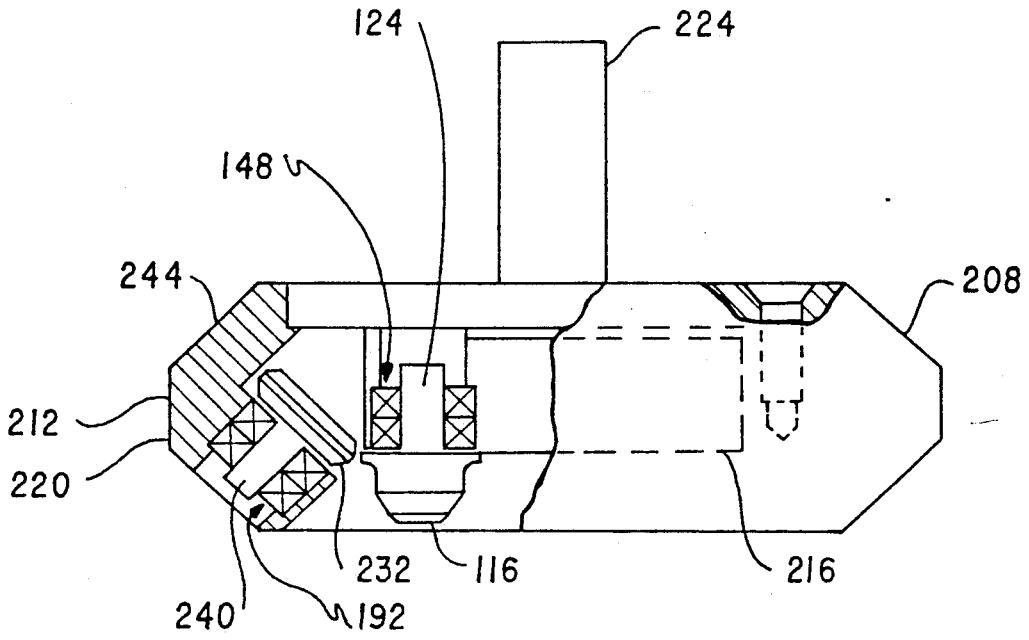
FIG. 4 is a cross-sectional view of an alternative plug resizing apparatus which has been adapted to perform the process of the present invention.
Figure 5:
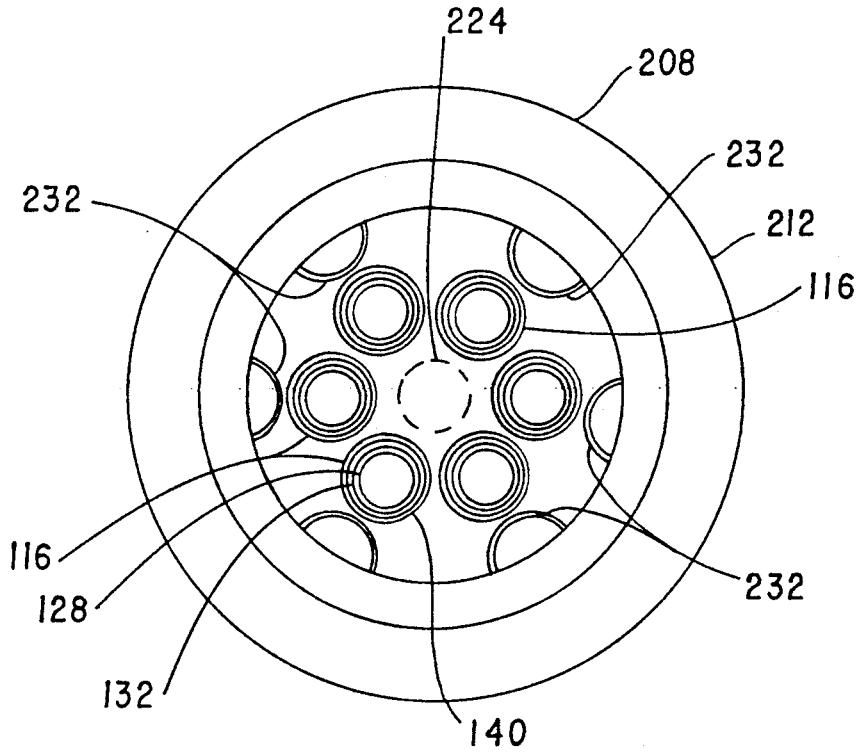
FIG. 5 is a front view of the apparatus of FIG. 4.

Based upon the foregoing description of the first plug resizing apparatus 44 as it is used to perform the process of the present invention, it can be appreciated that the first working rollers 176 may assume a variety of positions and still function in the required manner. For instance, as illustrated in FIG. 1, the rotational axes of the first working rollers 176 are substantially parallel with the rotational axis of the first plug resizing apparatus 44, which is again aligned with the longitudinal axis of the container 16 (FIG. 3). However, the rotational axes of the first working rollers 176 may also be positioned to be transverse to the rotational axis of the first plug resizing apparatus 44. One embodiment of this particular configuration is illustrated in FIGS. 4–5 and is discussed in more detail below. Moreover, as illustrated in FIGS. 2 and 5, the working rollers may be concentrically positioned about, effectively, the longitudinal axis of the container 16.

Figure 2:
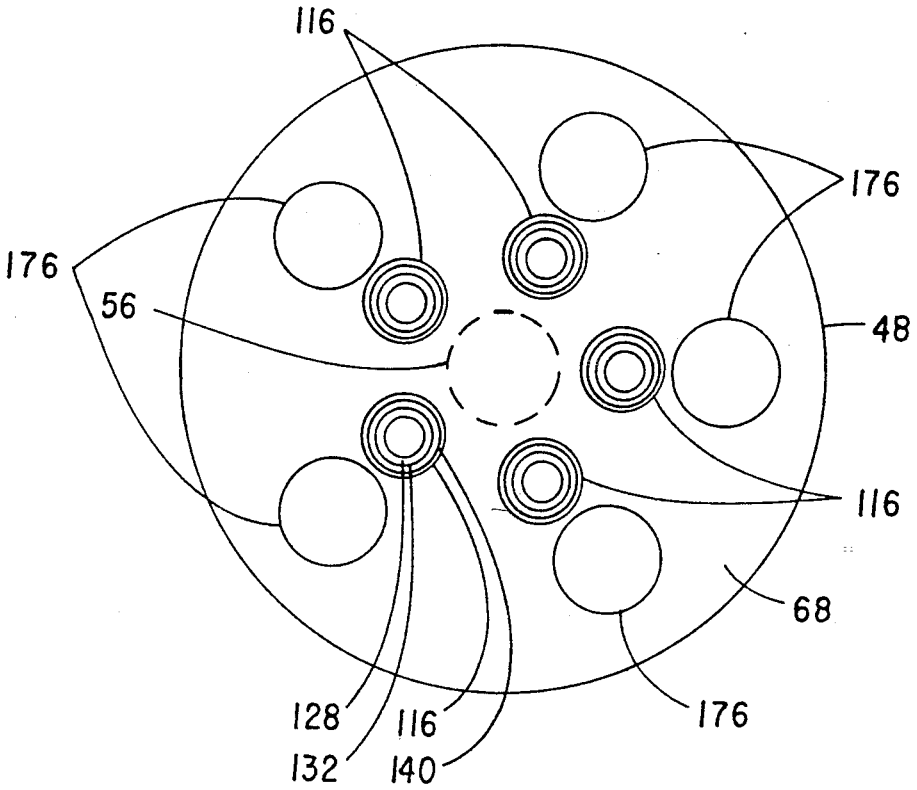
FIG. 2 is a front view of the apparatus of FIG. 1.

The second plug resizing apparatus 208 of FIGS. 4–5 is effectively operationally similar to the first plug resizing apparatus 44 of FIGS. 1–2 discussed above except that it utilizes a transverse orientation for the second working rollers 232 in order to perform the process of the present invention. However, to accommodate the desired transverse orientation of the second working rollers 232, the structure of the second plug resizing apparatus 208 is slightly modified from that of the first plug resizing apparatus 44. In this regard, the second plug resizing apparatus 208 includes a second outer housing 212 and a second inner housing 216 which are appropriately connected such that the entire second plug resizing apparatus 208 is able to rotate and axially advance relative to the container 16 (FIG. 3). As was the case with the first plug resizing apparatus 44, preferably the second plug resizing apparatus 208 is rotated and axially advanced by an appropriate drive source(s), although relative rotational and axial motion are the only limitations of the second plug resizing apparatus 208 in this regard. Consequently, a second drive shaft 224, appropriately connected to the second plug resizing apparatus 208, is connected to the drive source(s) for imparting rotational and axial motion to the second plug resizing apparatus 208.

The second inner housing 216 supports the plurality of concentrically positioned resizing rollers 116 which are supported therein by first bearing assemblies 148 and is substantially contained within the second outer housing 212. The second inner housing 216, resizing rollers 116, and first bearing assemblies 148 are substantially similar to the corresponding components of the first plug resizing apparatus 44 and are thus only generally illustrated in FIG. 4. In order to accommodate the desired transverse positioning of the second working rollers 232, however, the structure of the second outer housing 212 is modified from that of the first outer housing 48 of FIG. 1. More particularly, portions of each of the second sides 220 extend sufficiently beyond the second inner housing 216 such that the second working rollers 232 may be positioned in the transverse orientation best illustrated in FIG. 4. Consequently, the shafts 240 of each of the second working rollers 232 are positioned within the lower portion of the second sides 220, again seated within a second bearing assembly 192 (only generally illustrated), such that portions of the second working rollers 232 are in close proximity to the arcuately-shaped bases 140 of the resizing rollers 116. Due to this required structural modification, the resizing rollers 116 are positioned within an opening defined by the second sides 220.

When the second working rollers 232 are positioned as illustrated in FIGS. 4–5, particularly desirable results have been achieved when the second working rollers 232 have a concave surface 244 which, depending upon the extent of axial progression of the second plug resizing apparatus 208, may force the flange 40 of the container 16 (FIG. 3) into a downward curl. Moreover, when utilizing this transverse positioning of the second working rollers 232, the amount of wrinkling and metal deformation of the flange 40 has been reduced. Although six second working rollers 232 are illustrated in FIG. 5, any number which will effectively perform the process of the present invention may be utilized.

Figure 6:
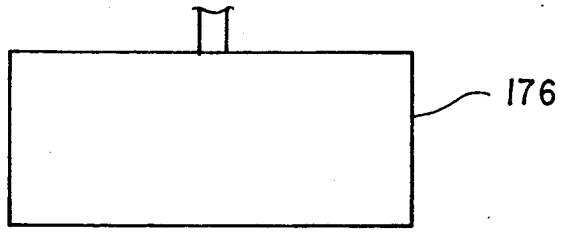
FIG. 6 is a side view of a straight-walled flange working roller.
Figure 7:
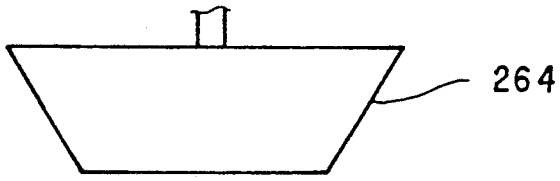
FIG. 7 is a side view of a tapered flange working roller.
Figure 8:
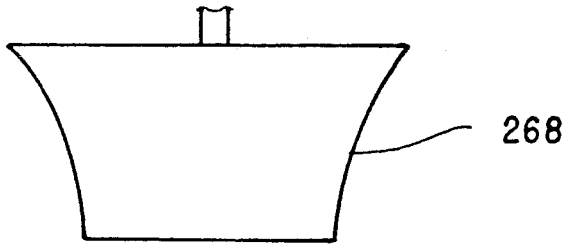
FIG. 8 is a side view of a curved flange working roller.
Figure 9:
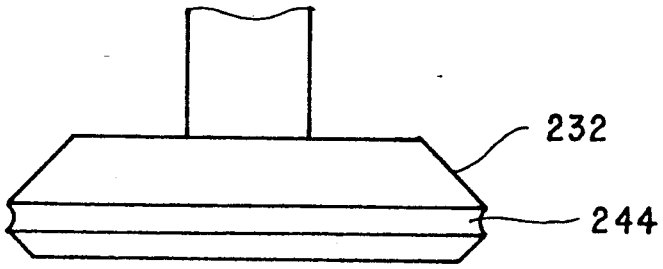
FIG. 9 is a side view of a concave flange working roller.

As can be appreciated, by altering the contour of the body of the working rollers used, the flange 40, in addition to being shaped by the working rollers, may be configured into a desired angular orientation with respect to the sidewalls 32 of the container 16 in a manner suitable for the particular end-piece attachment method to be used. Various configurations of the working rollers are illustrated in FIGS. 6–9. In FIG. 6, the first working roller 176 is substantially cylindrical such that if the rotational axis of such roller 176 is positioned to be substantially parallel with the longitudinal axis of the container 16, as illustrated in FIG. 1, the end configuration of the flange 40 will be substantially normal to the sidewalls 32. In the event it is desirable to position the flange 40 into a downward orientation, a tapered working roller 264 such as that illustrated in FIG. 7 or a curved working roller 268 such as that illustrated in FIG. 8 may be used. In the event it is desirable to have a downwardly curled flange 40, the second working roller 232 of FIGS. 4 and 9 may be used. Each of these variations of working rollers may be appropriately positioned relative to the longitudinal axis of the container 16 to produce a desired end configuration of a flange 40.

Although the present invention has been described with reference to a first and second plug resizing apparatus 44, 208, those skilled in the art will appreciate that the present invention may be utilized with a variety of container processing apparatus. In this regard, the only limitations of the present invention are that there must be a mechanism for rotating the working rollers about the edge of the flange 40 of the container 16 and for forcing the flange 40 into contact with at least one of these working rollers. Moreover, as previously stated, relative rotational motion is all that is required by the present invention and thus the working rollers, more particularly their rotational axes, may be substantially stationary (i.e., not traveling along a circular path) relative to a rotating container 16. Furthermore, it can be appreciated that the process of the present invention may be performed with, for instance, a plugging apparatus (not shown) which includes an appropriately contoured arcuate surface against which the open end of a container may be driven to force the flange toward the working rollers. Furthermore, although the first working rollers 176 were actually incorporated within the structure of the first and second plug resizing apparatus 44, 208, these rollers may be positioned on a structure independent from that which forces the flange 40 toward the working rollers.

The present invention also is not limited for use in combination with the container 16 of FIG. 3 and its particular illustrated configuration. For instance, the process of the present invention may be performed on necked/unnecked, flanged/unflanged, beaded/unbeaded containers, and various combinations thereof. However, if an existing container forming/processing apparatus is utilized to provide certain required functions of the present invention, there may be certain inherent limitations in choosing a container configuration in using that particular structure in order to provide functions not required by the present invention.

The process of the present invention will be described with regard to the first plug resizing apparatus 44 which incorporates the plurality of first working rollers 176 as illustrated in FIGS. 1-2 for working the container 16 of FIG. 3. In this regard, the container 16 is appropriately secured, most often by an apparatus which engages the bottom 20 so as to not interfere with the resizing of the throat 36 by the resizing rollers 116 and the working of the edge of the flange 40 by the first working rollers 176. Thereafter, the first plug resizing apparatus 44 is rotated and axially advanced toward the container 16. The resizing rollers 116 will initially come within the throat 36 of the container 16 due to the angulation of the first and/or second angled surfaces 128, 132. As the first resizing rollers 116 axially progress within and rotate around the perimeter of the throat 36, the diameter thereof increases due to the increasing taper of the resizing body portion 120 of the resizing rollers 116. During this increase in diameter of the throat 36, the flange 40 is also directed radially outward toward the first working rollers 176 which are rotating in conjunction with the resizing rollers 116 about the container 16. In this regard, portions of the flange 40 may actually be deflected toward the first working rollers 176 by the arcuately-shaped bases 140. At some point during the process, an edge portion of the flange 40 will contact at least one of the rotating first working rollers 176. The rotation of the first working rollers 176 about the flange 40 works and shapes such edge portion to improve uniformity of the flange 40. In the event inward axial progression of the resizing rollers 116 continues, the first working rollers 176 will restrict further outward radial migration of those edge portions of the flange 40 contacting the rollers 176, while remaining portions of the flange 40 will approach and possibly contact the rollers 176 to be shaped and worked. This further improves the uniformity of the flange 40 as discussed above.

While various embodiments of the present invention have been described in great detail, it is apparent that modifications and adaptations of these embodiments will occur to those skilled in the art. It is to be expressly understood that such modifications and adaptations are within the spirit and scope of the present invention as set forth in the claims which follow below.

What is claimed is:

1. An apparatus for working an edge portion of a flange, said flange extending in a first direction and being positioned on an open end of a container body, said container body having a longitudinal axis with said flange extending away from said longitudinal axis of the container body, comprising:

a housing having a central axis;

a plurality of rotatable rollers mounted on said housing and circumferentially positioned about said central axis of said housing, said rollers being radially outwardly from the flange edge of the container body when said central axis of said housing and the longitudinal axis of the container body are substantially aligned, said rollers each having a working surface;

rotational driving means associated with said apparatus for imparting rotation to at least one of said container body or said housing to cause relative rotational motion between the container body about its longitudinal axis and said rollers about said central axis of said housing; and forcing means associated with said housing radially inwardly of said rollers and positionable inside the open end of the container body, for forcing the edge of said alone of the container body radially outwardly toward said rollers, wherein said working surface of each of said rollers engagable with the edge portion is disposed to substantially restrict movement of the flange edge in the first direction and to work the edge portion when engaged therewith.

2. An apparatus, as claimed in claim 1, wherein a rotational axis of at least one of said rollers is substantially parallel with said central axis of said housing.

3. An apparatus, as claimed in claim 1, wherein a rotational axis of at least one of said rollers is in a plane transverse relative to said central axis of said housing.

4. An apparatus, as claimed in claim 1, wherein said working surface of at least one of said rollers has a tapered portion to work at least a portion of the flange edge into an orientation extending away from the first direction.

5. A apparatus, as claimed in claim 1, wherein said working surface of at least one of said rollers has a concave portion to work at least a portion of the flange edge into a curl at least partially extending away from the first direction.

6. An apparatus, as claimed in claim 1, wherein said housing is driven by said rotational driving means.

7. An apparatus, as claimed in claim 1, wherein said forcing means includes plug resizing rollers which exert an axial and radical force on inner walls of the container body.

8. An apparatus, as claimed in claim 1, wherein said forcing means includes an axial restraining means having an arcuate surface for forcing the flange edge radially outwardly toward said rollers and an axial driving means for establishing relative axial motion between said forcing means and the container body.

9. An apparatus for working an edge portion of a flange, said flange extending in a first direction and being portioned on an open end of a container, near a throat of the container, said container having a longitudinal axis with said flange extending away from said longitudinal axis of the container, comprising:

a housing;

means associated with said housing for increasing a diameter of the throat from a first diameter to a second diameter greater than the first diameter said means for increasing being positionable inside the open end of said container to exert a force on the throat, at least a portion of said force being in a direction away from the longitudinal axis of the container;

a plurality of rotatable first rollers positioned on said housing and radially outwardly from said means for increasing, each of said first rollers having a working surface; and rotational driving means associated with said apparatus for imparting rotation to at least one of said container or said housing to cause relative rotational motion between the container about its longitudinal axis and said plurality of first rollers, wherein the increase in diameter of the throat by said means for increasing forces the flange radially outwardly toward said first rollers and wherein said working surface of each of said first rollers engagable with the edge portion is disposed to substantially restrict movement of the flange edge in the first direction and to work the edge portion when engaged therewith.

10. An apparatus, as claimed in claim 9, wherein said means for increasing includes a plurality of rotatable second rollers, wherein said second rollers rotate relative to the container and linearly advance relative to and axially within the container.

11. An apparatus, as claimed in claim 10, wherein said plurality of second rollers are substantially circumferentially positioned about the longitudinal axis of the container.

12. An apparatus, as claimed in claim 10, wherein at least a portion of one of sad second rollers is tapered.

13. An apparatus, as claimed in claim 10, wherein at least one of said second rollers includes an arcuately-shaped base to direct the flange toward said first rollers.

14. An apparatus, as claimed in claim 9, wherein a rotational axis of at least one of said first rollers is substantially parallel with the longitudinal axis of the container.

15. An apparatus, as claimed in claim 9, wherein a rotational axis of at least one of said first rollers is in a plane transverse relative to the longitudinal axis of the container.

16. An apparatus, as claimed in claim 9, wherein said first rollers are substantially circumferentially positioned about the longitudinal axis of the container.

17. An apparatus, as claimed in claim 9, wherein said working surface of at least one of said first rollers has a tapered portion to work at least a portion of the flange into an orientation which extends away from said first direction.

18. An apparatus, as claimed in claim 9, wherein said working surface of at least one of said first rollers has a concave portion to work at least a portion of the flange into a curl at least partially extending away from said first direction.

19. An apparatus, as claimed in claim 9, wherein said means for increasing is connected to said rotational driving means.

20. A method for working an edge portion of a alone positioned on an end of a container, said container having a longitudinal axis and said flange extending in a first direction away from said longitudinal axis, comprising the steps of:

forcing at least a portion of the flange further away from said longitudinal axis of the container;

limiting an amount of movement of the flange away from the longitudinal axis by positioning a plurality of rotatable rollers radially outwardly and about the longitudinal axis, wherein said rollers rotate relative to and about the flange edge portion; and substantially restricting movement of the flange edge in the first direction and working the flange edge portion by establishing contact with at least one of said rollers and by rotating said at least one roller relative to and about the edge portion.

21. A method, as claimed in claim 20, wherein said rollers are substantially circumferentially positioned about the longitudinal axis of the container.

22. A method, as claimed in claim 20, further including forcing at least a portion of the flange into an orientation which extends away from the first direction.

23. A method, as claimed in claim 20, further including forcing at least a portion of the flange into a curl at least partially extending away from the first direction.

24. An apparatus for working an edge portion of a flange, said flange extending in a first direction and being positioned on an open end of a container, said container having a longitudinal axis with said flange extending away from said longitudinal axis of said container, comprising:

a housing having a central axis;

a plurality of rotatable rollers mounted on said housing and circumferentially positioned about said central axis of said housing, said rollers being radially outwardly from the flange edge of the container when said central axis of said housing and said longitudinal axis of said container are substantially aligned, said rollers each having a working surface, wherein a rotational axis of at least one of said rollers is in a plane transverse relative to said central axis;

rotational driving means associated with said apparatus for imparting rotation to at least one of said container or said housing to cause relative rotational motion between the container about said longitudinal axis of the container and said rollers about said central axis of said housing; and forcing means associated with said housing radially inwardly of said rollers and positionable inside the open end of said container, for forcing the edge of said flange of the container radially outwardly toward said rollers, wherein at least a portion of the flange edge contacts and is worked by said working surface of at least one of said rollers.

25. An apparatus for working an edge portion of a flange, said flange extending in a first direction and being positioned on an open end of a container, said container having a longitudinal axis with said flange extending away from said longitudinal axis of said container, comprising:

a housing having a central axis;

a plurality of rotatable rollers mounted on said housing and circumferentially positioned about said central axis of said housing, said rollers being radially outwardly from the flange edge of the container when said central axis of said housing and the longitudinal axis of the container are substantially aligned, said rollers each having a working surface;

rotational driving means associated with said apparatus for imparting rotation to at least one of said container or said housing to cause relative rotational motion between the container about said longitudinal axis of the container and said rollers about said central axis of said housing;

forcing means associated with said housing radially inwardly of said rollers and positionable inside the open end of the container, for forcing the edge of said flange of the container radially outwardly toward said rollers, said forcing means including an axis restraining means having an arcuate surface for forcing the flange edge radially outwardly toward said rollers and an axial driving means for establishing relative axial motion between said means for forcing and the container, wherein at least a portion of the flange edge contacts and is worked by said working surface of at least one of said rollers.

26. An apparatus for working an edge portion of a flange, said flange extending in a first direction and being positioned on an pen end of a container near a throat of said container, said container having a longitudinal axis with said flange extending away from said longitudinal axis of said container, comprising:

a housing;

means associated with said housing for increasing a diameter of the throat from a first diameter to a second diameter greater than the first diameter, said means for increasing being positionable inside the open end of said container to exert a force on the throat, at least a portion of said force being in a direction away from the longitudinal axis of the container;

a plurality of rotatable first rollers positioned on said housing and radially outwardly from said means for increasing, each of said first rollers having a working surface, wherein a rotational axis of at least one of said first rollers is in a plane transverse relative to said longitudinal axis of the container when engaged by said means for increasing; and rotational driving means associated with said apparatus for imparting rotation to at least one of said container or said housing to cause relative rotational motion between the container about its longitudinal axis and said plurality of first rollers, wherein the increase in diameter of the throat by said means for increasing forces the flange radially outwardly toward said first rollers and wherein said working surface of at least one of said first rollers contacts and rotates relative to and about the edge of the flange.

* * * * *

UNITED STATES PATENT AND TRADEMARK OFFICE

CERTIFICATE OF CORRECTION

PATENT NO. : 5,150,595

DATED : September 29, 1992

INVENTOR(S) : Eugen F. Ihly

It is certified that error appears in the above-identified patent and that said Letters Patent is hereby corrected as shown below:

Column 8, line 10, please delete "6" and insert therefor -- 68 --.

Column 13, line 61, please delete "sad" and insert therefor -- said --.

Column 14, line 21, please delete "alone" and insert therefor -- flange --.

Column 15, line 36, please delete "axis" and insert therefor -- axial --.

Column 15, line 36, please delete "an" and insert therefor -- any --.

Column 16, line 7, please delete "pen" and insert therefor -- open --.

Signed and Sealed this

Fourteenth Day of September, 1993

Bruce Lehman

*Attest:*

*Attesting Officer*

BRUCE LEHMAN

*Commissioner of Patents and Trademarks*